US006364717B1

(12) United States Patent
Lin

(10) Patent No.: US 6,364,717 B1
(45) Date of Patent: Apr. 2, 2002

(54) AUDIO JACK WITH A CONTROLLED NORMAL FORCE FOR RETAINING A MATING PLUG

(75) Inventor: Yi Sheng Lin, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/751,434

(22) Filed: Dec. 29, 2000

(30) Foreign Application Priority Data

Nov. 10, 2000 (TW) ..... 89219489

(51) Int. Cl.[7] ..... H01R 24/04
(52) U.S. Cl. ..... 439/668
(58) Field of Search ..... 439/668, 669, 439/188, 733.1, 862

(56) References Cited

U.S. PATENT DOCUMENTS 5,022,872 A * 6/1991 Schichida ..... 439/668
5,338,215 A * 8/1994 Lee et al. ..... 439/668
5,919,052 A * 7/1999 Ho ..... 439/668
6,077,126 A * 6/2000 Peng ..... 439/668
6,116,959 A * 9/2000 Taylor ..... 439/668

* cited by examiner

*Primary Examiner*—Gary Paumen
(74) *Attorney, Agent, or Firm*—Wei Te Chung

(57) ABSTRACT

An audio jack includes an insulating housing (1), a retention pad (4), at least one resilient contact (2) and at least one fixed contact (3). The housing defines a longitudinal hole (12) therethrough for receiving a mating plug (50). The retention pad has a base (40) and a protrusion (41) formed in substantially a middle of the base for pressing against the plug. The resilient contact includes a fixing section (21) for retaining in the housing and a cantilevered beam (24) diagonally extending opposite to the fixing section. The cantilevered beam extends into the hole from a top wall (13) of the housing and forms a contact section (25) at a distal end of the cantilevered beam for contacting the plug. The force provided by the protrusion against an inserted plug controls the force acting against the cantlevered beams, protecting the beams from failure.

1 Claim, 8 Drawing Sheets

AUDIO JACK WITH A CONTROLLED NORMAL FORCE FOR RETAINING A MATING PLUG

FIELD OF THE INVENTION

The present invention relates to an audio jack, and particularly to an audio jack applying a firm retaining force on a mating plug.

BACKGROUND OF THE INVENTION

U.S. Pat. No. 5,022,872 discloses a jack, as shown in FIG. 8. The jack comprises a housing 5, a first contact 6, a second contact 7 and a third contact 8. The first contact 6 has a spring contact portion 65 extending upwardly and inwardly from one side of a rectangular frame 64 and is mounted in a groove 109. The first contact 6 also has a soldering tail 66 extending downward from a lower edge of the frame 64. The second contact 7 has the same configuration as the first contact 6. The third contact 8 is formed as a U-shaped metal piece and has two flexible contact pieces 88 extending forwardly from a top and bottom edges thereof for gripping a tip electrode of a plug (not shown) therebetween. A pair of soldering tails 87 respectively extend downward from opposite sides of the third contact 8.

The spring contact portions of the first and second contacts 6, 7 and the contact pieces 88 of the third contact 8 are bent to possess a certain degree of resiliency for securely abutting the plug. However, due to a large required contact normal force from the spring contact portions and the contact pieces against the plug, the contact portions tend to yield or become damaged after a period of use, resulting in an unreliable connection with the plug.

The present invention is directed to solving the above problems and features an audio jack having an element providing a controlled normal force in addition to signal contacts for retaining a mating plug, thereby effectively preventing the signal contacts from mechanically failing.

BRIEF SUMMARY OF THE INVENTION

A main object of the present invention is to provide an audio jack with a controlled normal force for retaining a mating plug.

Another object of the present invention is to provide an audio jack which effectively prevents contacts from mechanically failing.

An audio jack in accordance with the present invention comprises an insulating housing, a plurality of resilient contacts, a plurality of fixed contacts and a retention pad securely fixed in the housing. The housing defines a longitudinal plug-insertion hole therethrough for receiving a mating plug.

Each resilient contact includes a fixing section for fixing the resilient contact in the housing and a cantilevered beam diagonally extending opposite to the fixing section. The cantilevered beam extends into the plug-insertion hole from a top wall of the housing. A contact section is formed at a distal end of the cantilevered beam for contacting the plug. Each fixed contact is configured like the fixing section of the resilient contacts. The retention pad includes a base retained in the housing and a protrusion for pressing against the plug. The protrusion is formed on the base in any known manner, such as by stamping or coining.

When the plug is inserted into the housing, the contact section of each resilient contact electrically engages with a corresponding constituent electrode of the plug to establish a desired electrical connection between the plug and the audio jack. At the same time, the protrusion of the retention pad bears against the plug with a predetermined force. Preferably, the protrusion of the retention pad exerts a strong enough force against the plug to keep the resilient contacts from being overloaded. Therefore, the amount of yield of the resilient contacts is greatly reduced. The height of the protrusion of the retention pad can be adjusted during its formation by, for example, precision stamping to meet the requisite criteria.

Other objects, advantages and novel features of the invention will become more apparent from the following detailed description when taken in conjunction with the accompanying drawings.

DETAILED DESCRIPTION OF THE PREFERRED EMBODIMENT

Figure 1:
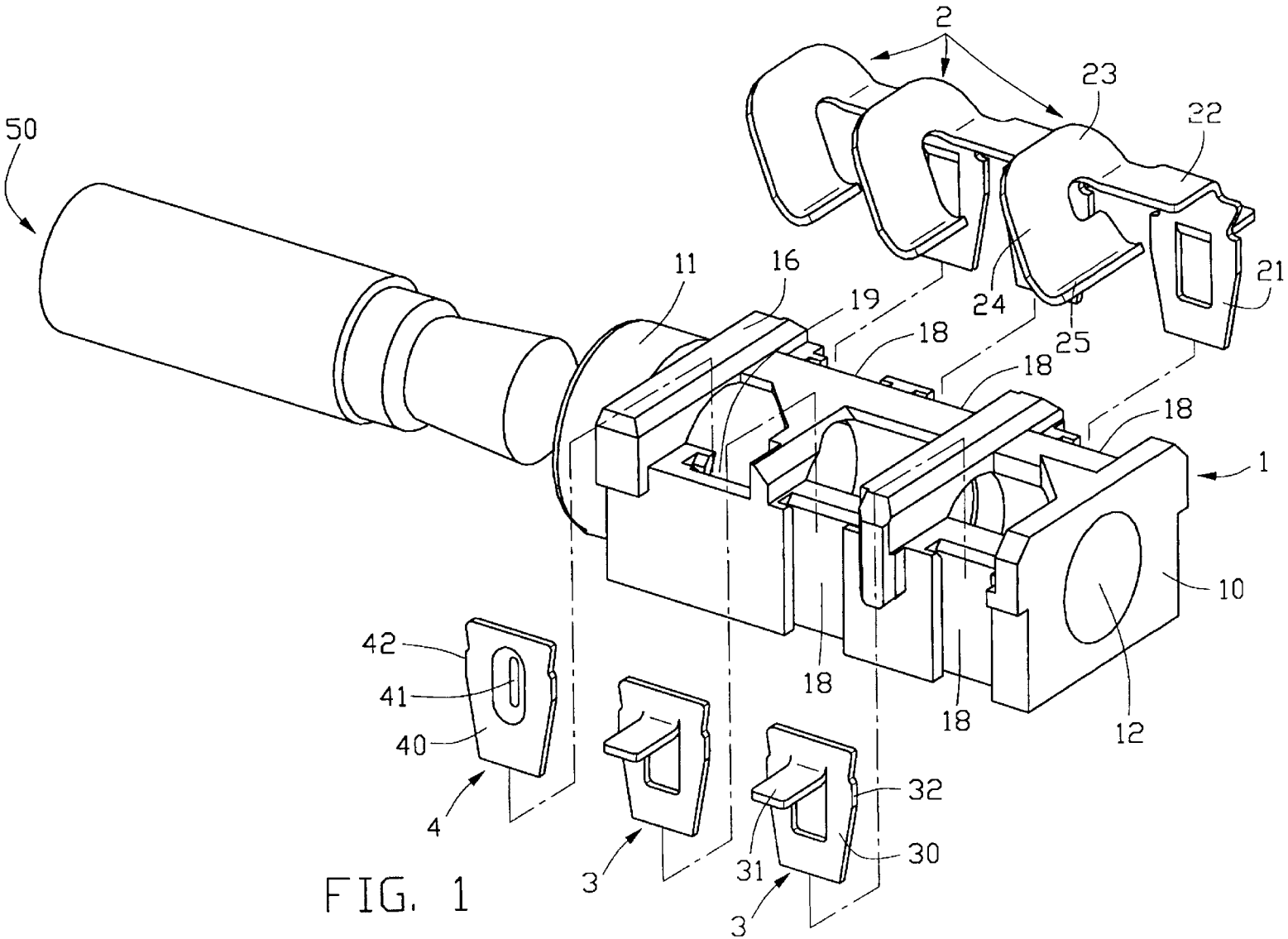
FIG. 1 is an exploded view of an audio jack of the present invention.
Figure 2:
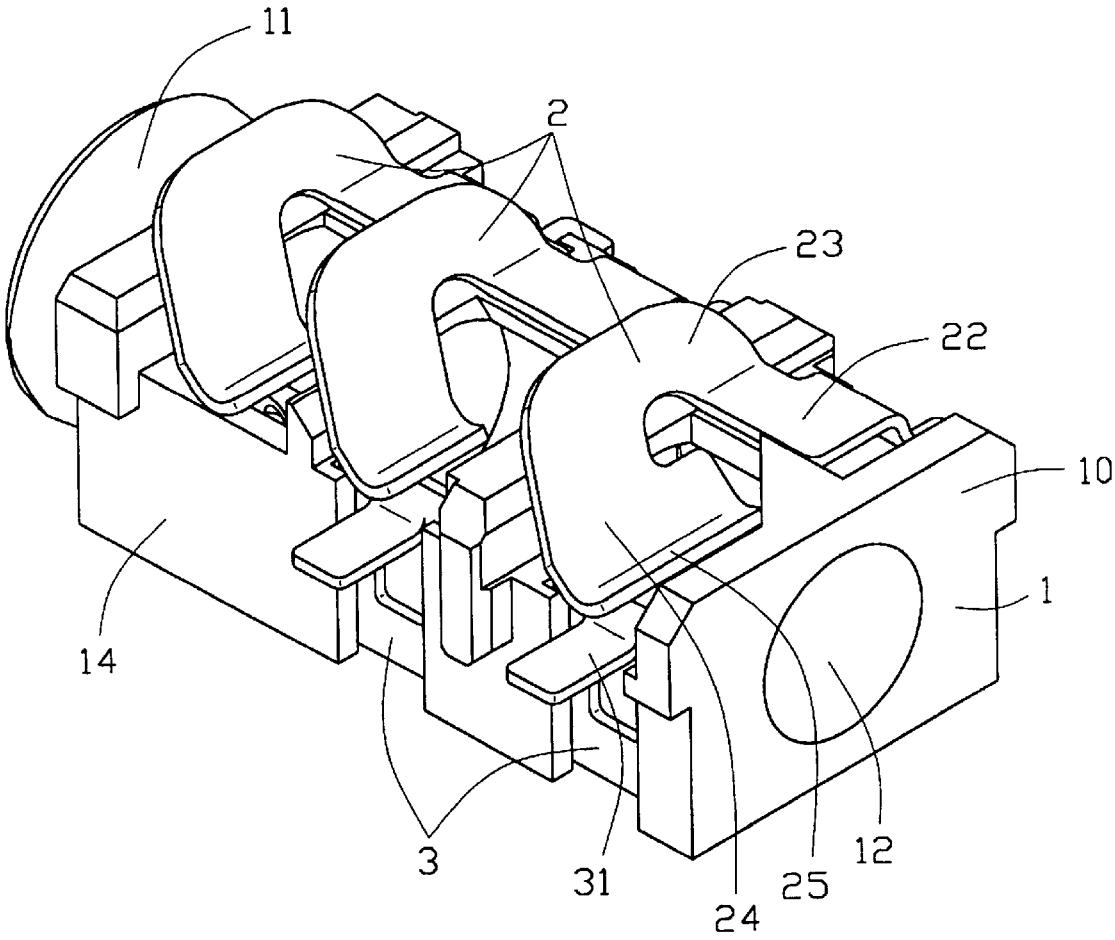
FIG. 2 is an assembled view of the audio jack of FIG. 1.

Referring to FIGS. 1 and 2, an audio jack according to the present invention comprises an insulating housing 1, a plurality of resilient contacts 2, a plurality of fixed contacts 3 and a retention pad 4.

Figure 3:
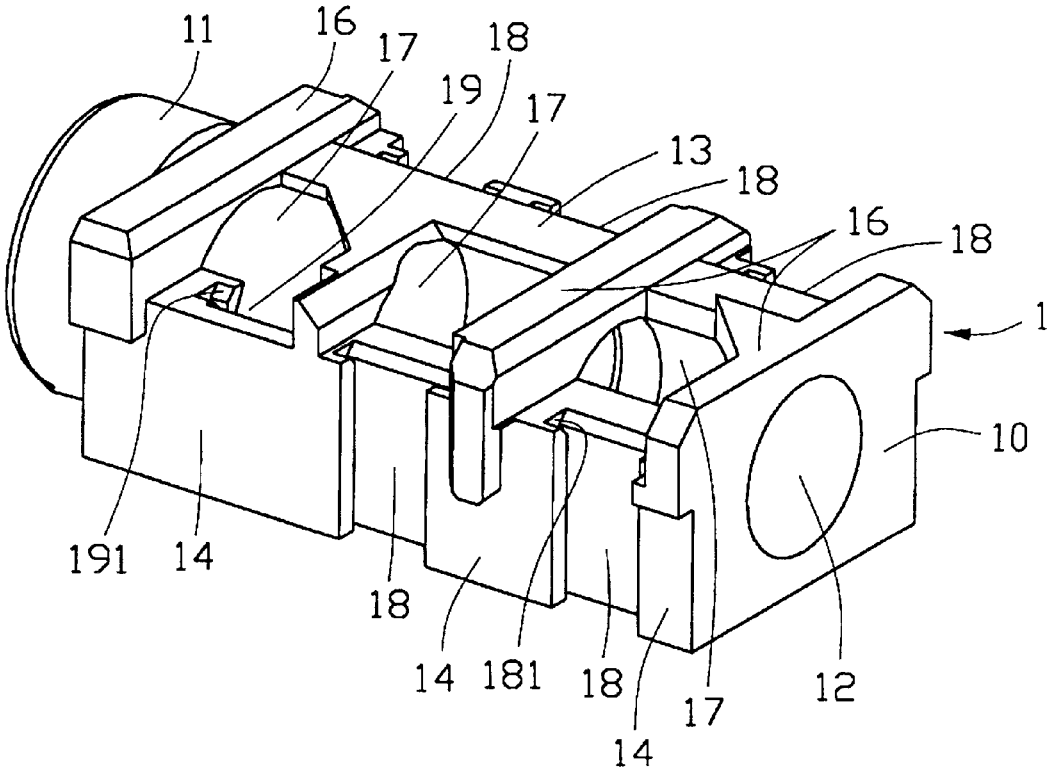
FIG. 3 is a perspective view of a housing of the audio jack.

Referring to FIG. 3, the housing 1 includes a substantially rectangular main body 10 and a cylindrical sleeve 11 forwardly extending from a front face of the main body 10. A plug-insertion hole 12 is longitudinally defined through the main body 10 and the sleeve 11 for receiving a plug 50 therein.

Figure 7:
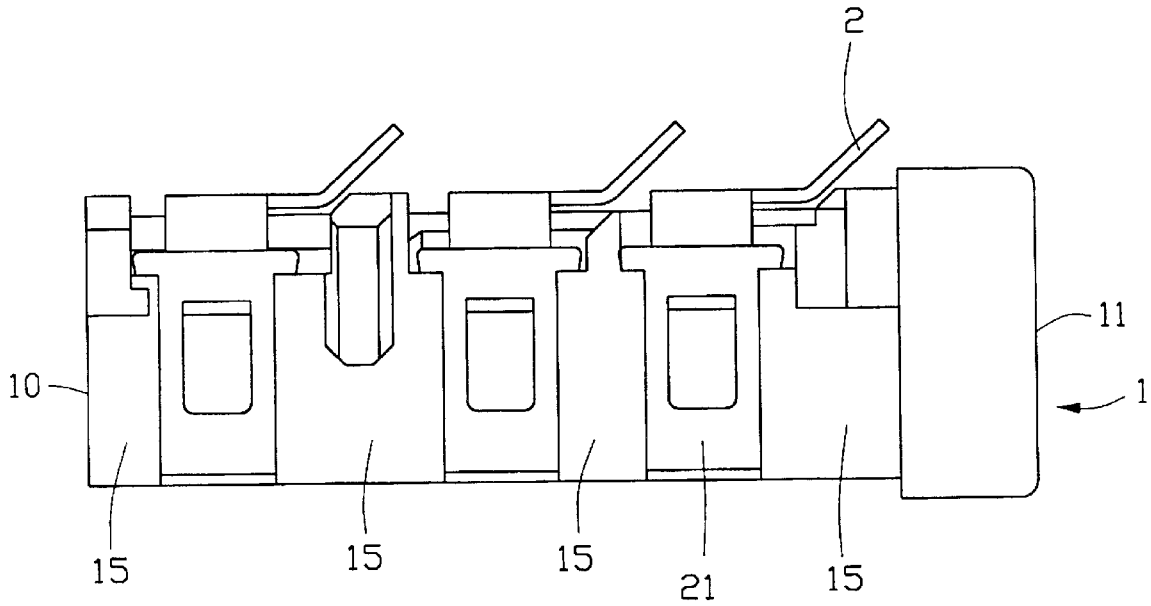
FIG. 7 is a left-side view of FIG. 2.
Figure 8:
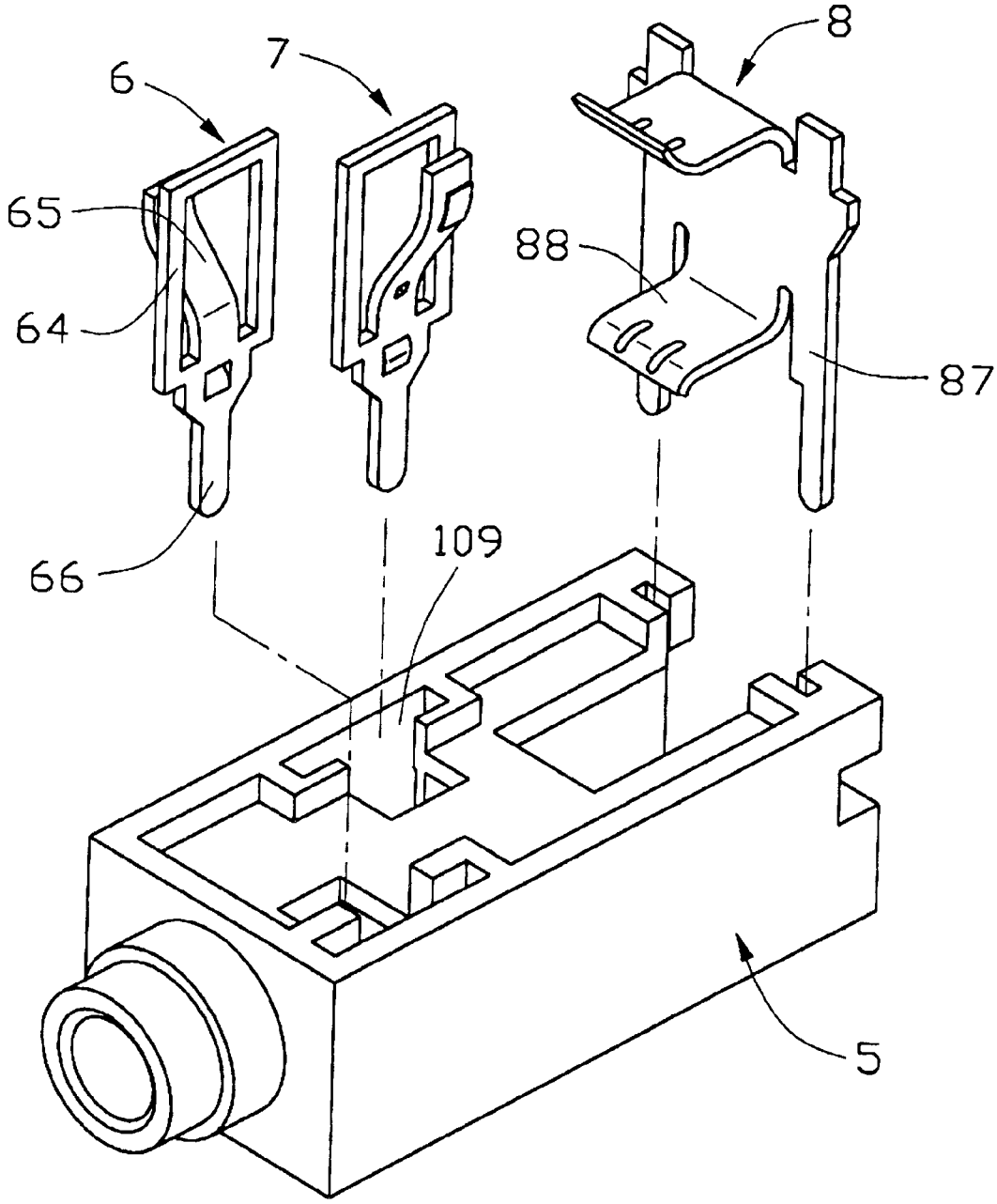
FIG. 8 (PRIOR ART)
FIG. 8 is an exploded view of a conventional jack.

The main body 10 has a top wall 13, a first sidewall 14 and a second sidewall 15 (see FIG. 7) opposite the first sidewall 14. A plurality of girders 16 bestride the top wall 13, two ends of each girder 16 being respectively situated on the first sidewall 14 and the second sidewall 15. A plurality of openings 17 are defined in the top wall 13 and communicate with the plug-insertion hole 12.

A plurality of grooves 18 are respectively defined in outer sides of the first and second sidewalls 14 and 15 for receiving the resilient contacts 2 and the fixed contacts 3. A pair of cutouts 181 are defined in opposite sides of each groove 18 opposing each other. A groove 19 is defined in the inner side of the first sidewall 14, extending from the top to the bottom thereof for receiving the retention pad 4 therein. A pair of cutouts 191 are respectively defined in two opposite sides of the groove 19.

With reference to FIG. 1, the fixed contacts 3 each cooperate with a corresponding resilient contact 2 and have a substantially rectangular and planar base 30 and a rectangular solder tab 31 stamped perpendicularly outward therefrom for surface mounting on a circuit board (not shown). A pair of barbs 32 are formed on two opposite edges of each base 30 for securely retaining the fixed contacts 3 in the cutouts 181 of the grooves 18 of the housing 1.

Figure 4:
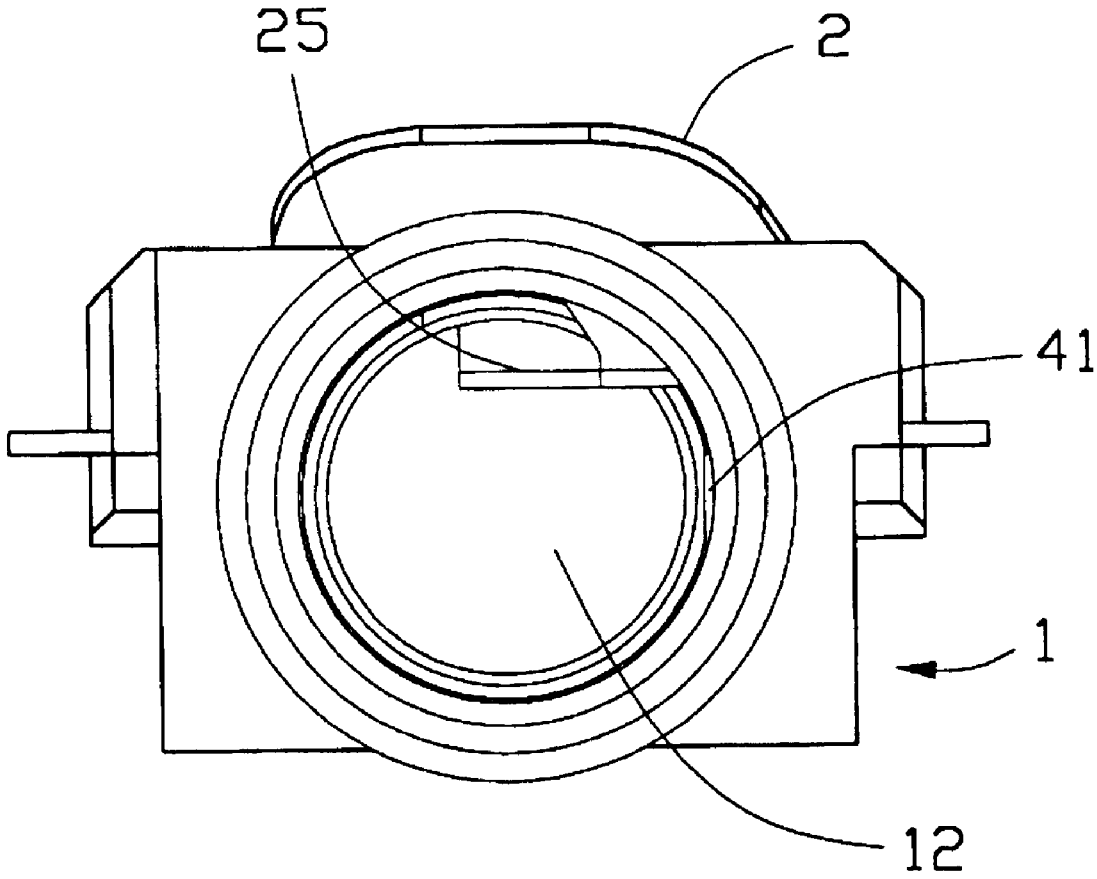
FIG. 4 is a front view of FIG. 2.

Each resilient contact 2 comprises a substantially rectangular and planar fixing section 21 for retaining the resilient contact 2 in the housing 1, a horizontal linking section 22 extending perpendicularly from the fixing section 21, and a flexible section 23. The fixing section 21 has a structure identical to that of the base 30 of the fixed contact 3. The flexible section 23 extends diagonally in an arc, first upwardly and outwardly, then downwardly and inwardly, from the linking section 22. The arc curves to a side of the linking section 22 opposite to that from which the fixing section 21 extends. A cantilevered beam 24 comprises the portion of the flexible section 23 which extends downwardly. A curved contact section 25 is formed at a distal end of the cantilevered beam 24 for contacting the plug 50. When the fixing section 21 of the resilient contact 2 is inserted into the groove 18, the contact section 25 partially enters the corresponding opening 17 into the plug-insertion hole 12 (see FIGS. 2 and 4).

The retention pad 4 includes a rectangular and planar base 40 and a protrusion 41 formed in any known manner, such as by stamping or coining on the base 40 for making contact with and pressing against the plug 50. The base 40 forms a pair of barbs 42 on two opposite edges thereof for securing to the housing 1.

Figure 6:
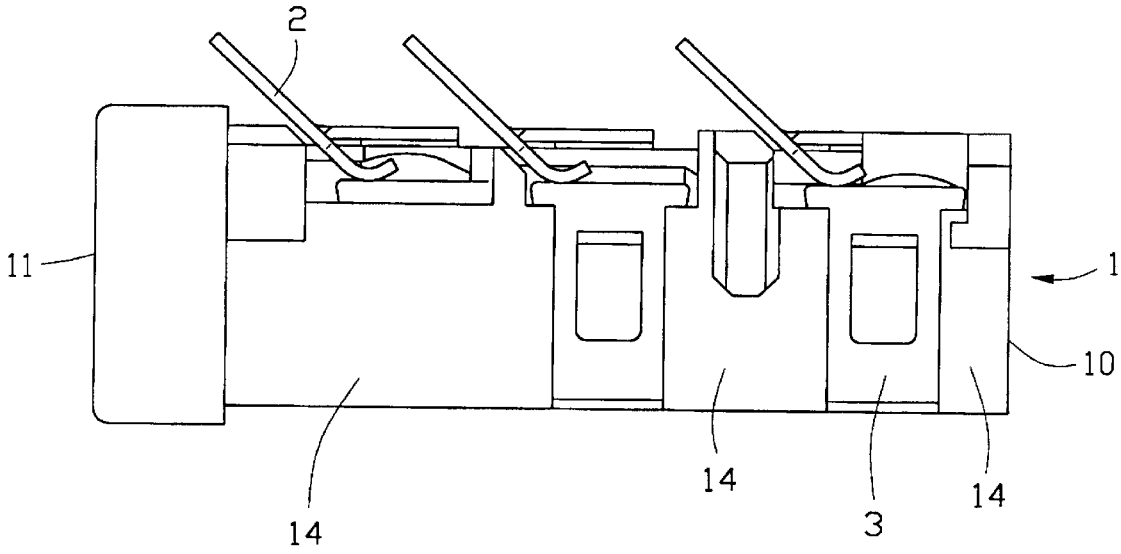
FIG. 6 is a right-side view of FIG. 2.

In assembly, with reference to FIGS. 2, 3 and 6, the fixed contacts 3 are inserted in the corresponding grooves 18 of the first sidewall 14 of the main body 10. The barbs 32 of each fixed contact 3 are retained in cutouts 181 of the groove 18. Further referring to the FIG. 7, the resilient contacts 2 are inserted in the second sidewall 15 of the main body 10. The fixing section 21 of each resilient contact 2 is respectively fixed in the corresponding contact-receiving groove 18. The retention pad 4 is securely fixed in the groove 19 of the main body 10, with the two barbs 42 secured in the cutouts 191.

Figure 5:
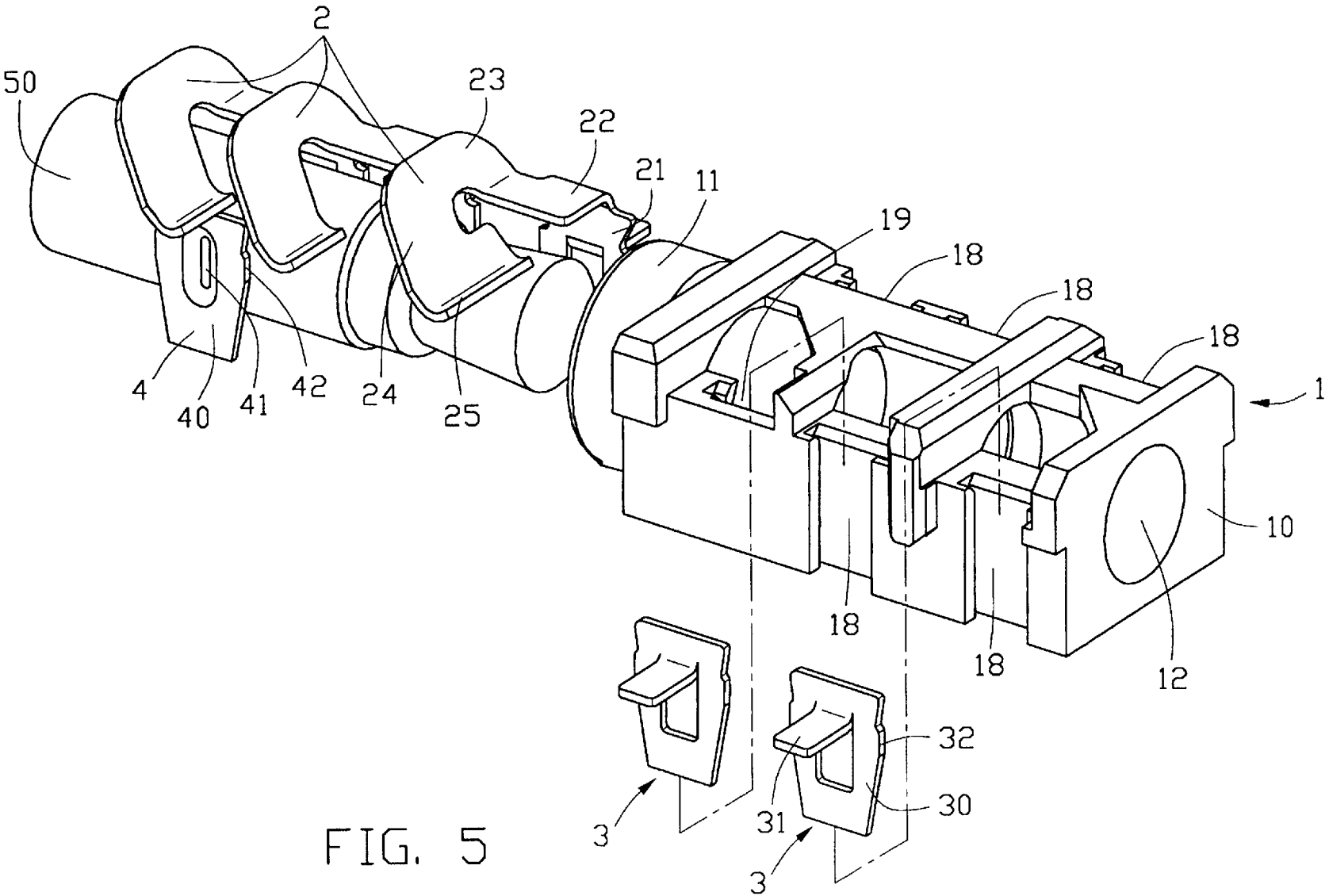
FIG. 5 is another exploded view of the audio jack, particularly showing how a plug to be inserted into the housing interacts with resilient contacts and a retention pad.

Referring to the FIG. 6, when the plug 50 is not inserted into the housing 1, the contact section 25 of each resilient contact 2 contacts with a corresponding fixed contact 3 or retention pad 4. Referring to the FIG. 5, when the plug 50 is inserted into the housing 1, the contact section 25 of each resilient contact 2 is displaced from the fixed contact 3 or retention pad 4 to instead contact a corresponding constituent electrode of the plug 50 to establish a desired electrical connection between the plug 50 and the audio jack. At the same time, the protrusion 41 of the retention pad 4 bears against the plug 50 with a predetermined force. Understandably, the total retention force to the inserted plug 50 is derived from the sum of the reaction forces of the three resilient contacts 2 and the retention pad 4. Preferably, the protrusion 41 of the retention pad 4 controllably exerts a strong enough force against the plug 50 so as to arrange the resilient contacts 2 to share less retention force thereof, i.e., less deflection thereof, thus keeping the resilient contacts 2 from being overloaded. Therefore, the amount of yield of the resilient contacts 2 is greatly reduced. The height of the protrusion 41 of the retention pad 4 can be adjusted during its formation by, for example, precision stamping to meet the requisite criteria. It is alsonoted that in this preferred embodiment, the retention pad 4 only provides mechanical engagement with the plug 50 rather than any further electrical transmission thereof.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An audio jack comprising:

an insulating housing defining a longitudinal plug-insertion hole therethrough for receiving a mating plug;

at least one resilient contact received in the housing and including a fixing section for retaining the resilient contact in the housing and a cantilevered beam diagonally extending opposite to the fixing section, the beam extending into the hole from a top wall of the housing and forming a contact section at a distal end thereof for contacting the plug; and a retention pad including a base retained in the housing and a protrusion formed on the base for pressing against the plug;

wherein a groove is defined in an inner sidewall of the housing for receiving the retention pad;

wherein the base of the retention pad forms a pair of barbs on two opposite edges thereof, and wherein the groove comprises a pair of cutouts for latching with the barbs;

wherein the protrusion of the retention pad is formed to a predetermined height;

wherein at least one fixed contact is provided to cooperate with the at least one resilient contact, the at least one fixed contact including a base and a solder tab perpendicularly extending from the base for surface mounting on a circuit board, and wherein at least one groove is defined in an outer sidewall of the housing for receiving a corresponding base;

wherein the at least one resilient contact comprises a horizontal linking section extending perpendicularly from the fixing section, and a flexible section extending diagonally from the linking section and pointing away from the fixing section;

wherein the cantilevered beam inclinedly extends from the flexible section.

* * * * *